US007086454B1

(12) United States Patent
Hsu

(10) Patent No.: US 7,086,454 B1
(45) Date of Patent: Aug. 8, 2006

(54) WICK STRUCTURE OF HEAT PIPE

(75) Inventor: Hul-Chun Hsu, Taichung (TW)

(73) Assignee: Jaffe Limited, Tortola (VG)

( * ) Notice: Subject to any disclaimer, the term of this patent is extended or adjusted under 35 U.S.C. 154(b) by 0 days.

(21) Appl. No.: 11/090,147

(22) Filed: Mar. 28, 2005

(51) Int. Cl.
*F28D 15/04* (2006.01)

(52) U.S. Cl. ..... 165/104.26; 165/104.33

(58) Field of Classification Search ..... 165/104.26, 165/104.33, 185; 29/890.032
See application file for complete search history.

(56) References Cited

U.S. PATENT DOCUMENTS 1,719,679 A * 7/1929 Bernard ..... 431/298
3,576,210 A * 4/1971 Trent ..... 165/104.26
4,109,709 A * 8/1978 Honda et al. ..... 165/104.26
6,427,765 B1 * 8/2002 Han et al. ..... 165/104.26
6,619,384 B1 * 9/2003 Moon et al. ..... 165/104.26
2002/0112334 A1 * 8/2002 Quick et al. ..... 29/419.1

FOREIGN PATENT DOCUMENTS

JP 2002-251487 * 10/2002 ..... 165/104.26

* cited by examiner

*Primary Examiner*—Teresa J. Walberg

(57) ABSTRACT

A the wick structure of a heat pipe includes a woven mesh curled to be located inside a tubular member of the heat pipe, and a plurality of fiber bundles longitudinal attached to an interior surface of the tubular member and sandwiched between the woven mesh and the tubular member. The fiber bundle provides capillary action in the longitudinal direction, and the woven mesh provides capillary action in the longitudinal direction, as well as in the transversal direction. Therefore, the wick structure can provide capillary action in both the longitudinal and transversal directions.

6 Claims, 4 Drawing Sheets

WICK STRUCTURE OF HEAT PIPE

BACKGROUND OF THE INVENTION

The present invention relates in general to a wick structure of a heat pipe, and more particularly, to a wick structure including a woven mesh and a plurality of fiber bundles.

As shown in FIGS. 1 and 2, conventional heat pipe 1*a* includes a tubular member 10*a* and a fiber bundle 11*a* longitudinally attached on an interior surface of the tubular member 10*a*. A support member 12*a* is further installed inside the tubular member 10*a* to press the fiber bundle 11*a* firmly attached to the tubular member 10*a*. Therefore, the gaps formed between the fibers of the fiber bundle 11*a* can provide capillary action along the longitudinal direction of the heat pipe 1*a*.

However, the fiber bundle 11*a* is arranged along the longitudinal direction, no capillary action is provide along the transversal direction of the heat pipe 1*a*. As such, the application of the conventional heat pipe 1*a* is limited.

Thus, there still is a need in the art to address the aforementioned deficiencies and inadequacies.

BRIEF SUMMARY OF THE INVENTION

The present invention provides an improved wick structure of a heat pipe. The wick structure includes a fiber bundle to provide excellent capillary action in the longitudinal direction, as well as in the transversal direction.

Another, the wick structure includes a woven mesh made of larger weaving fibers to provide support at annealing. Therefore, the attachment of the wick structure can be reliably proceeded, and the woven mesh with larger weaving fibers has lower cost.

Accordingly, the wick structure of the heat pipe includes a woven mesh curled to be located inside a tubular member of the heat pipe, and a plurality of fiber bundles longitudinal attached to an interior surface of the tubular member and sandwiched between the woven mesh and the tubular member. The fiber bundle can provide excellent capillary action in the longitudinal direction, and the woven mesh can provide capillary action in the longitudinal direction, as well as in the transversal direction. Therefore, the wick structure having the fiber bundles of the present invention can provide capillary action in both the longitudinal and transversal directions.

Furthermore, the woven mesh is made by a plurality of weaving fibers. Each weaving fiber has a size larger than any fiber of the fiber bundles. Therefore, the cost of the wick structure can be reduced and the wick structure can be reliably attached on the internal sidewall of the heat pipe.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

These as well as other features of the present invention will become more apparent upon reference to the drawings therein.

DETAILED DESCRIPTION OF THE INVENTION

Figure 1:
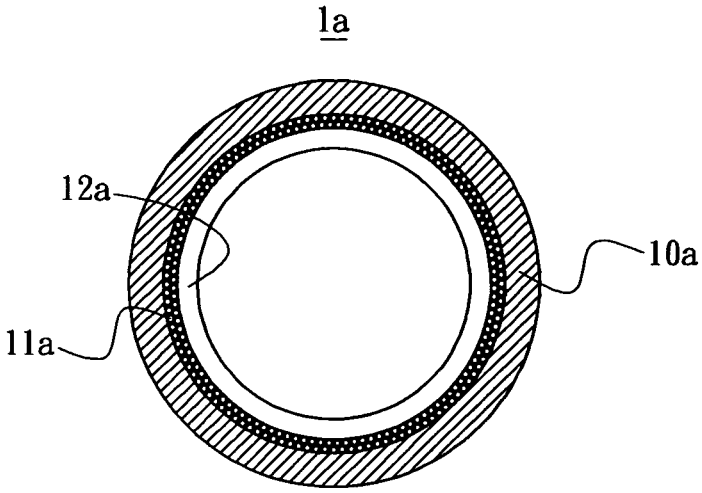
FIG. 1 PRIOR ART
FIG. 1 shows a cross sectional view of a conventional heat pipe in the transversal direction.
Figure 2:
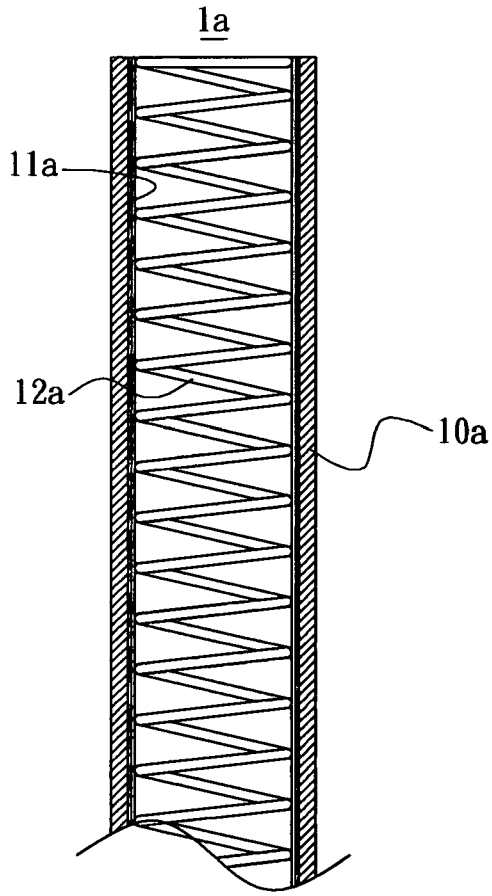
FIG. 2 PRIOR ART
FIG. 2 shows a cross sectional view of a conventional heat pipe in the longitudinal direction.

Reference will now be made in detail to the preferred embodiments of the present invention, examples of which are illustrated in the accompanying drawings. Wherever possible, the same reference numbers are used in the drawings and the description to refer to the same or like parts.

Figure 3:
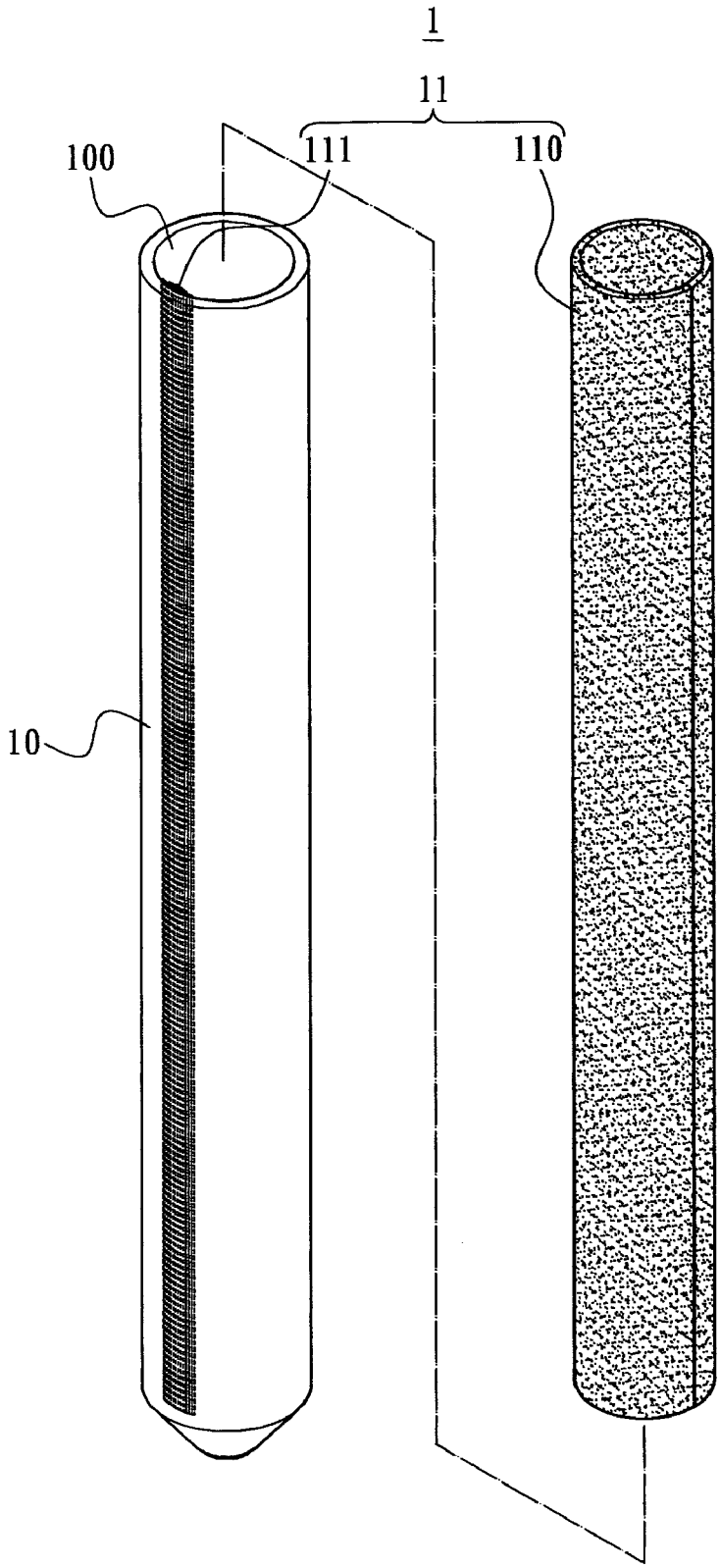
FIG. 3 shows an exploded view of a wick structure of the heat pipe according to the present invention.
Figure 4:
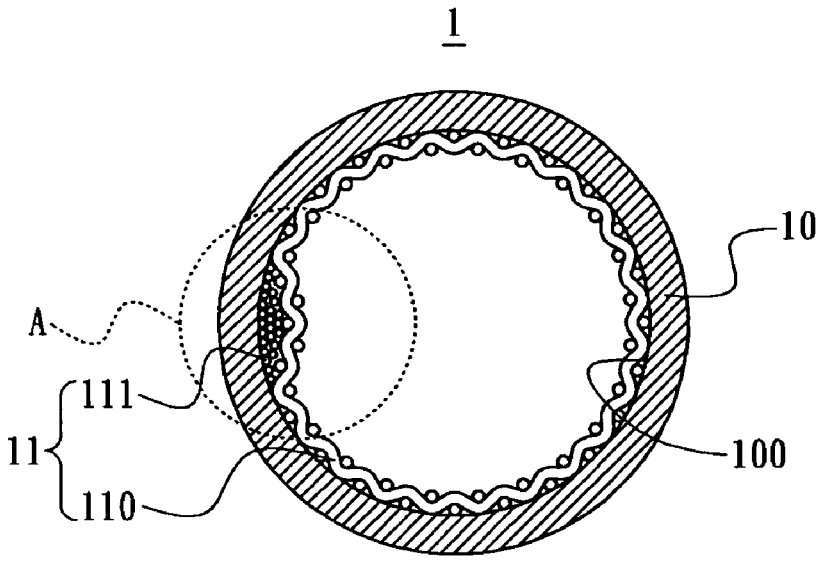
FIG. 4 shows a cross sectional view of a heat pipe with the wick structure provide by the present invention.

Please refer to FIGS. 3 and 4, which respectively show an exploded view of a heat pipe and a cross sectional view of a wick structure according to the present invention. The heat pipe 1 includes a tubular member 10 with a wick structure 11 attached on the interior surface 100 of the tubular member 10.

The wick structure 11 includes a woven mesh 110 curled to be located inside the tubular member 10. A plurality of fiber bundles 111 longitudinal are attached to an interior surface 100 of the tubular member 10 and sandwiched between the woven mesh 110 and the tubular member 10.

Figure 6:
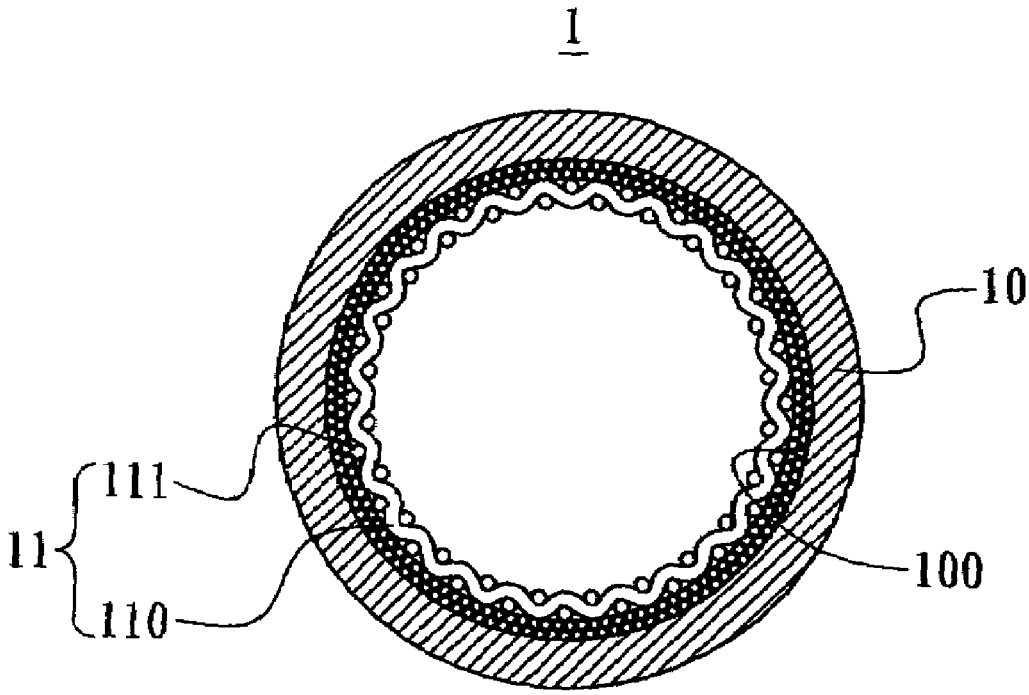
FIG. 6 shows a cross sectional view of a heat pipe with the wick structure according to another preferred embodiment of the present invention.

As shown in one preferred embodiment of FIG. 4, the fiber bundle 111 is locally attached on a predetermined area of the interior surface 100 so that the heat pipe 1 can particularly utilize this area to provide extra longitudinal capillary force. Nevertheless, in another preferred embodiment, as shown in FIG. 6, the fiber bundles 111 are totally attached on whole area of the interior surface 100. Therefore, all area of the heat pipe 1 can be used to provide extra longitudinal capillary force.

Accordingly, the wick structure 11 of the present includes both the woven mesh 110 and the fiber bundle 111. The fiber bundle 111 can provide excellent capillary action in the longitudinal direction, and the woven mesh 110 can provide capillary action in the longitudinal direction, as well as in the transversal direction. Therefore, the wick structure 11 of the present invention can provide capillary action in both the longitudinal and transversal directions.

Figure 5:
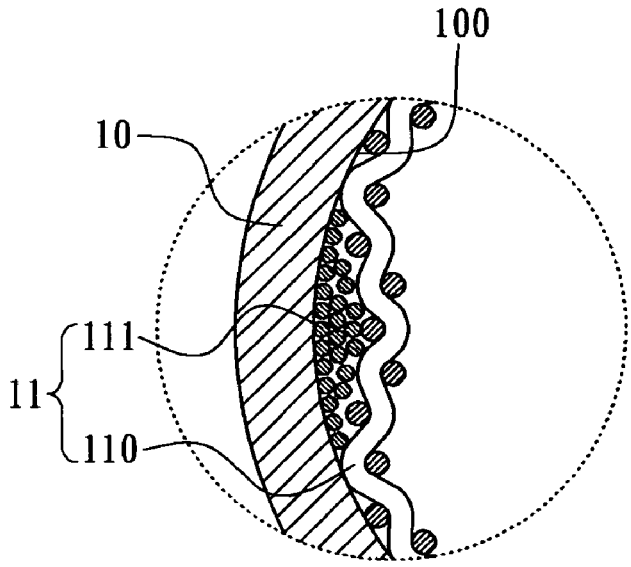
FIG. 5 shows an enlarged view of an A portion in FIG. 4.

Furthermore, as shown in FIG. 5, the woven mesh 110 is made by a plurality of weaving fibers. Each weaving fiber has a size larger than any fiber of the fiber bundles 111. When the fiber bundles 111 are softened at annealing in a high temperature, the woven mesh 110 with larger weaving fibers can provide support to the fiber bundles to be firmly attached to the tubular member 10. Therefore, the attachment of the wick structure can be reliably proceeded, and the cost of the wick structure can be reduced because the woven mesh with larger fibers is less expensive.

Last, the fiber bundle 111 can include a plurality of fibers with two different sizes, and/or the fibers of the fiber bundle 111 can be twisted together or just put together without twisting. Moreover, the fiber bundles 111 can be integrally formed on the woven mesh 110 so as to facilitate the wick structure 11 to be installed inside the tubular member 10.

This disclosure provides exemplary embodiments of wick structure of a heat pipe. The scope of this disclosure is not limited by these exemplary embodiments. Numerous variations, whether explicitly provided for by the specification or implied by the specification, such as variations in shape, structure, dimension, type of material or manufacturing process may be implemented by one of skill in the art in view of this disclosure.

What is claimed is:

1. A wick structure of a heat pipe, comprising:

a tubular member;

a woven mesh curled to be located inside the tubular member of the heat pipe; and a plurality of fiber bundles longitudinal attached to at least portion of the interior surface of the tubular member, and are sandwiched between the woven mesh and the tubular member, wherein the fiber-diameter of the woven mesh are larger than the fiber-diameter of the fiber bundles.

2. The wick structure of claim 1, wherein the fiber bundles are locally attached on a predetermined area of the interior surface.

3. The wick structure of claim 1, wherein the fiber bundles are totally attached on whole area of the interior surface.

4. The wick structure of claim 1, wherein the fiber bundles are integrally formed on the woven mesh.

5. The wick structure of claim 1, wherein the fiber bundle includes a plurality of fibers twisted together.

6. The wick structure of claim 1, wherein the fiber bundle includes a plurality of fibers with two different sizes.

* * * * *